United States Patent [19]

Kuechler

[11] 4,038,912

[45] Aug. 2, 1977

[54] COMBINATION FORCED-FLOW AND CONVECTIVE-FLOW GREASE-HOOD SYSTEM AND METHOD HAVING A LOW-LEVEL ENTRY PORTION OVER A PROTRUDING COOKING APPLIANCE

[75] Inventor: Irvin R. Kuechler, San Bernardino, Calif.

[73] Assignee: Vent-Cair, Inc., San Bernardino, Calif.

[21] Appl. No.: 618,832

[22] Filed: Oct. 1, 1975

Related U.S. Application Data

[63] Continuation-in-part of Ser. No. 497,690, Aug. 15, 1974, Pat. No. 3,943,836.

[51] Int. Cl.[2] ..... F23J 11/00

[52] U.S. Cl. ..... 126/299 D; 55/DIG. 36

[58] Field of Search ..... 98/115 R, 115 K; 126/299 R, 299 B; 55/DIG. 36, 439, 467

[56] References Cited

U.S. PATENT DOCUMENTS

| | | | |
|---|---|---|---|
| 3,400,649 | 9/1968 | Jensen | 98/115 K |
| 3,411,428 | 11/1968 | Ahlrich | 98/115 K |
| 3,457,850 | 7/1969 | Sweet et al. | 98/115 K |
| 3,664,255 | 5/1972 | Kuechler | 98/115 K |

*Primary Examiner*—Ronald C. Capossela
*Attorney, Agent, or Firm*—Richard L. Gausewitz

[57] ABSTRACT

The entry or intake portion of a grease-hood system is mounted at a low elevation, far below the elevation of the head of the cook. Furthermore, such entry portion does not extend clear to the front of the cooking appliance disposed therebeneath, thus the cooking appliance protrudes outwardly from beneath the entry portion. The apparatus and method are such that the flow of fumes and air from the cooking appliance to the entry portion of the hood is substantially entirely the result of convection. There is, however, a forced flow in the hood system at a region above the entry portion, the forced flow being such that fumes and air are directed at the grease filter means. In the forced-flow portion of the system, air from outside the room is passed directly to the grease hood, and air and fumes which pass through the grease filter means are passed to a region exterior to the room and/or are recirculated back to the hood. There is a vortical flow of air and fumes in the forced-flow portion of the system.

The system includes, in two of its embodiments, a plate shelf and/or a pass-through in combination with the grease hood.

12 Claims, 5 Drawing Figures

COMBINATION FORCED-FLOW AND CONVECTIVE-FLOW GREASE-HOOD SYSTEM AND METHOD HAVING A LOW-LEVEL ENTRY PORTION OVER A PROTRUDING COOKING APPLIANCE

CROSS-REFERENCE TO RELATED APPLICATION:

This application is a continuation-in-part of my co-pending application Ser. No. 497,690, filed Aug. 15, 1974, for Apparatus for Removing Fumes From the Space Above a Cooking Appliance In a Restaurant, by Irvin R. Kuechler now U.S. Pat. No. 3,943,836.

BACKGROUND OF THE INVENTION

1. Field of the Invention

This invention relates to the field of grease-hood systems for removing grease and smoke from the spaced above cooking appliances, particularly in restaurants.

2. Description of Prior Art

There are, in general, two types of grease-hood systems commonly enjoyed in restaurants at the present time in the United States. One is the "canopy" type wherein the entire hood is disposed at an elevation sufficiently high that the cook stands beneath a portion thereof. Such canopy hoods are normally quite large and expensive.

The second type of grease-hood system has a low-level intake portion far beneath the elevation of the head of the cook. In such systems, the stove or other cooking appliance often protrudes forwardly from beneath the intake portion, thus permitting the cook to see what is cooking on the rear portion of the cooking appliance, and also permitting the cook to bend forwardly (wihout bumping his head) to manipulate food on such rear portion of the cooking appliance.

The conventional operation of such last-mentioned type of hood is to employ an exhaust blower to suck large amounts of air and fumes through the grease filters, without providing any supply of air from outside the room to the grease-hood system. Such apparatus is vastly wasteful of energy and produces other important bad effects including, for example, the creating of excessive drafts in the restaurant. Other prior-art systems do not rely merely on the sucking of air through the systems but additionally blow air from outside the room to the vicinity of the cooking appliance (at an elevation far below that of the intake or entry portion of the grease-hood system). For example, Jensen U.S. Pat. No. 3,400,649 brings supply air down to the back of the cooking appliance, then blows and sucks it up through the filters. The forced-flow upwardly-directed air in such Jensen patent is stated to create a venturi effect which draws room air back over the cooking surface.

There have long existed smoke hoods which do not incorporate any grease fillers or any blowers, and thus are totally unsatisfactory from standpoints of smog, fire hazards, etc. Some such hoods did not extend to the front of the cooking surfaces therebeneath, and relied upon convection to move the fumes rearwardly and upwardly from the front regions of the cooking surfaces.

Relative to a further aspect of the present disclosure, there have long existed restaurants which have plate shelves and/or pass-throughs beneath or adjacent the smoke hoods. However, such restaurants did not achieve anything approximating the economy, efficiency, etc., of the shelf-grease hood combination disclosed herein. In particular, ther were no (insofar aS applicant is aware) forced-flow filter-type grease hoods which were so constructed that only a natural convective flow of air and cooking fumes passed upwardly adjacent the pass-through and/or the plate shelf.

SUMMARY OF THE INVENTION

In accordance with the present apparatus and method, the entry or intake portion of the grease-hood system is disposed far below the elevation of the cook's head, and the cooking appliance protrudes outwardly from beneath such entry portion, yet convection is relied upon substantially entirely to create a flow of room air rearwardly across the cooking surface and thence upwardly into the entry portion. After the fumes and air reach the inner portions of the system, above such entry portion, they are entrained in forcec-flow air which is delivered to the system from a region exterior to the room. Portions of the fumes and air are then either passed directly through the grease filters or are whirled in a large upper vortex and then passed through such grease filters to an exhaust blower or recirculation means.

In the present apparatus and method, there is no need for any venturi effect, no need for bringing supply air down to the elevation of the cooking appliance (with consequent large amounts of expensive ducting, etc.), and no necessity of depleting from the room any quantity of air greater than that required for the substantially convective flow. The apparatus and method are simple, economical and effective, and meet the requirements for numerous types of franchise and other restaurants wherein it is often not desired to employ a large canopy hood beneath which the cook stands.

In accordance with the present method, the heat of the appliance creates, from the protruding cooking region not overhung by the entry portion of the grease-hood system, a major rearward convective flow of room air. Such flow is primarily adjacent the cooking surface and is not interfered with or substantially augmented by forced-flow means. However, mixing with supply or recirculated air from outside the room occurs as soon as the upper regions of the grease-hood system are reached. Effective vortexing is employed for energy dissipation and improved filtration.

To enhance the rearward flow of convecting air over the cooking surface, the apparatus and method preferably employ means for restricting or preventing flow of air beneath the cooking appliance. Furthermore, sidewalls are employed at the sides of the cooking appliance to prevent drafts and the like in other than a front-to-rear direction.

In one embodiment, there is provided above the forward region of the cooking appliance at least one wall or shelf, preferably a plate or storage shelf and/or a pass-through shelf. Air from the room drawn rearwardly over the upper portion of the stove or other cooking appliance, by the upwardly rising hot air therefrom, entrains cooking fumes. The hot air and fumes then convect upwardly, rearwardly of the stated wall or shelf, through the open bottom of the capture chamber in the grease hood. Thereafter, the air and fumes are entrained in a laminar curtain of inlet air and are directed toward the grease filters. Some of the air and fumes are whirled around in upper and lower vortexes before flowing through the filters.

Brief Description of the Drawings:

FIG. 4 is an elevational view, partially in side elevation and partially in vertical section, showing a preferred embodiment of the type wherein there is a plate shelf (warming shelf) but not a pass-through.

DESCRIPTION OF THE PREFERRED EMBODIMENT

Figure 1:
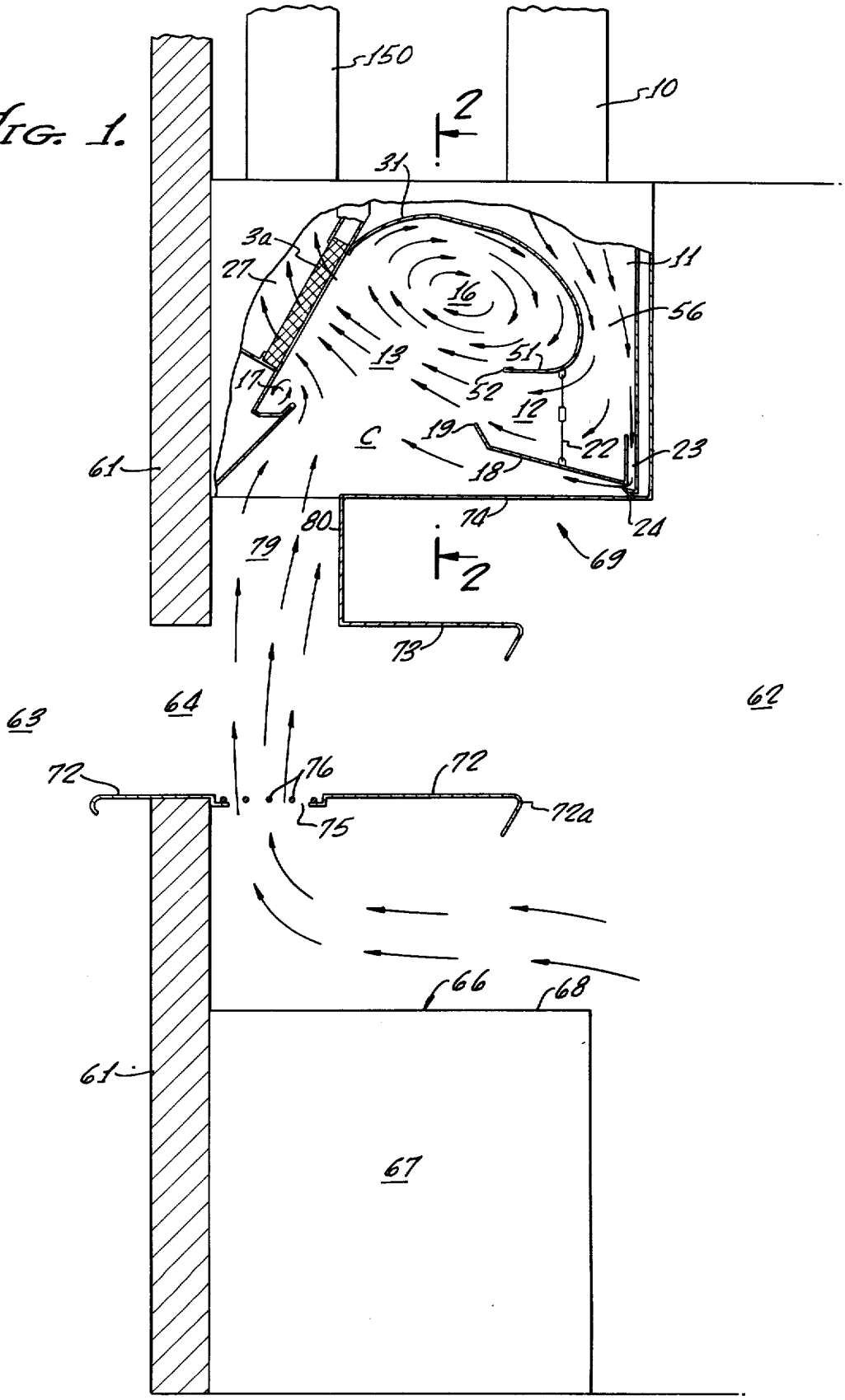
FIG. 1 is a vertical view, partially in side elevation and partially in vertical section, showing an embodiment wherein there is a pass-through disposed over the cooking appliance.

Except as specifically stated herein, the apparatus is substantially the same as that described and claimed in patent No. 3,664,225, issued May 23, 1972, for Apparatus and Method for Removing Fumes from the Space Above a Cooking Appliance. The disclosure of said patent is hereby incorporated by reference herein as though set forth in full. The disclosure of said U.S. Pat. No. 3,943,836 is also hereby incorporated by reference herein, as though set forth in full.

DESCRIPTION OF THE FORCED-FLOW PORTIONS, EMBODIMENT OF FIGS. 1-3

To summarize (with reference to FIGS. 1-3) the disclosure of said Pat. No. 3,943,836, a supply blower (not shown in the present drawing) is employed to draw air from a region exterior to the room in which the cooking appliance is disposed, and supplies such air (referred to as inlet air) downwardly through a duct means (the lower region of which is shown at 10 in the present patent application, FIG. 1) to a supply chamber (numbered 11 in the present application) and thence to a generally horizontal throat portion (numbered 12 in the present application) which may also be generally described as a director means.

From the throat portion 12, the incoming air flows in a stream or air curtain 13 which is inclined upwardly and rearwardly and which is generally perpendicular to filter means 3*a*. Some of the air in curtain 13 passes directly through the filter means 3*a*; some of the air therein passes upwardly and forms part of a large-diameter upper vortex 16; and some of the air passes downwardly and forms part of a small-diameter lower vortex 17. Eventually, all of the inlet air from throat 12 (not only that which flows directly through the filter, but also that which recirculates for a period of time in the upper and lower vortexes 16 and 17) passes through the filter means 3*a* and is exhausted to the exterior of the room as described below.

The housing of the present smoke hood apparatus comprises an open-bottomed capture and entrainment chamber "C" into which grease-containing fumes pass from the cooking appliance which is disposed beneath the smoke hood apparatus. In such capture and entrainment chamber "C", the grease-containing fumes are entrained in the air 13 and therefore are directed at high velocity toward the filter means 3*a*. Furthermore, and particularly when the inlet air from the exterior of the room is relatively cool (although it is emphasized that the inlet air is almost always substantially cooler than the upflowing fumes) there is a substantial chilling action having a tendency to solidify the grease particles in the fumes. As the filter means 3*a* are approached, some of the air and fumes in air curtain 13 swerves upwardly into the upper vortex 16, whereas other of the air and fumes swerves downwardly into the lower vortex 17. However, despite such swerving of the air, the entrained heavy grease particles continue their forward motion and tend to impinge against the filter 3*a*, the result being a centrifugal separation action which occurs in the capture and entrainment chamber "C". The grease particles which impinge against the filter means 3*a* cling thereto and run down into trough means described in the cited U.S. Pat. No. 3,664,255.

Figure 3:
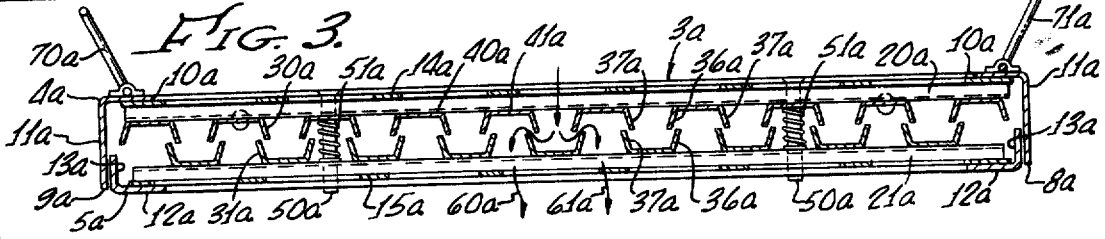
FIG. 3 is a horizontal sectional view taken on line 3—3 of FIG. 2, illustrating the filter means.

The filter means 3*a* is best shown in FIG. 3, and is described in U.S. Pat. No. 3,566,585, issued Mar. 2, 1971, for a Grease-Extracting Apparatus. The dislosure of said patent is hereby incorporated by reference herein as though set forth in full. Said filers are numbered 3*a* in the present application, and are preferably operated in the open mode (FIG. 4 of said U.S. Pat. No. 3,566,585), not in the closed mode (FIG. 5 of said patent). The numbers shown in FIG. 3 of the present application correspond to the numbering in said U.S. Pat. No. 3,566,585, except that in each instance the suffix "*a*" has been appended to the elements in FIG. 3 of the present application.

Figure 2:
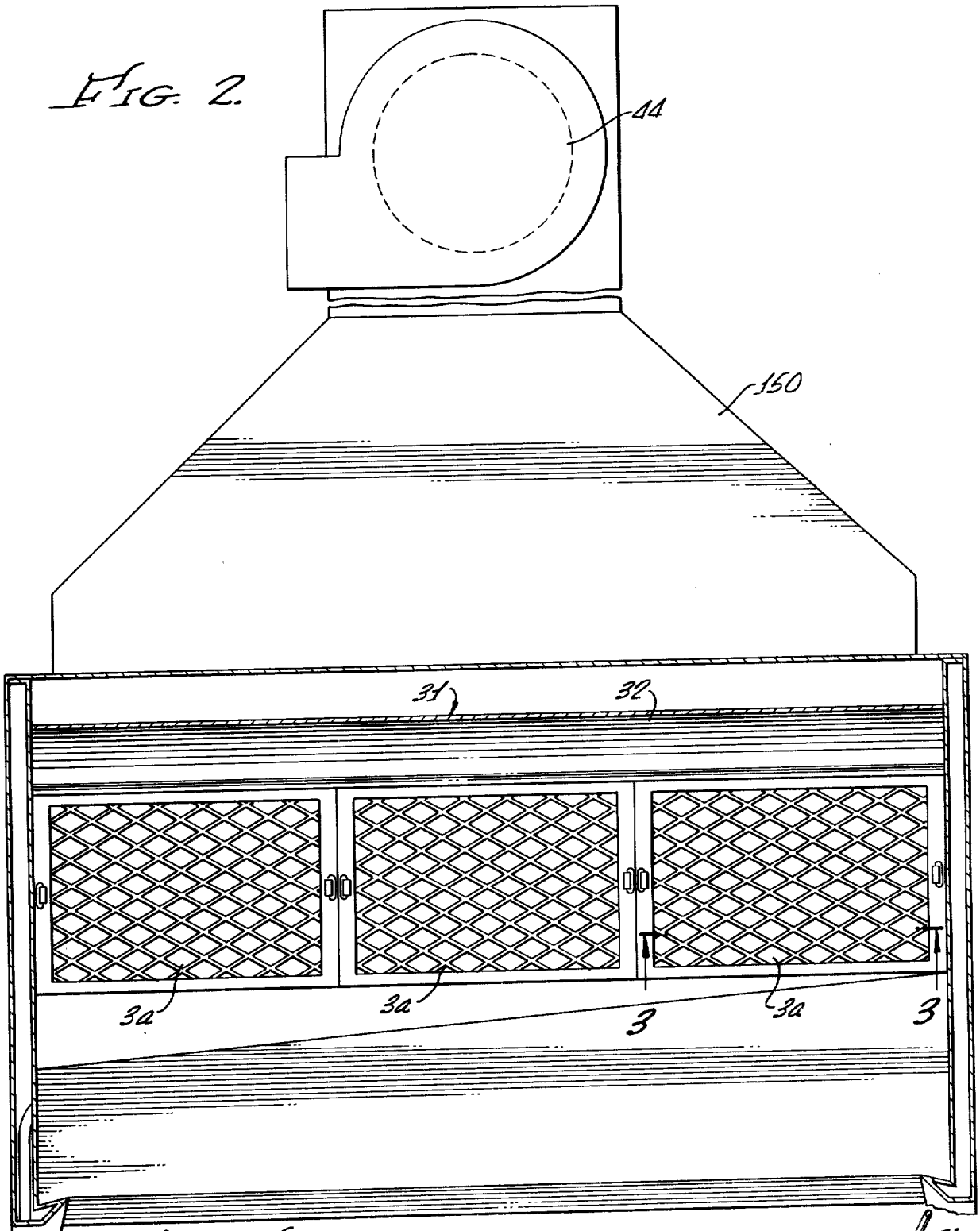
FIG. 2 is an enlarged vertical sectional view taken on line 2—2 of FIG. 1, and looking rearwardly, such FIG. 2 further illustrating the extent of the exhaust plenum and showing the exhaust blower.

In the filter means 3*a*, a second centrifugal separation action occurs (in addition to the above-described separation occurring by direct impingement), so that the degree of grease removal from the cooking fumes is very great. However, it is highly important that the flow of air and fumes through the filter means 3*a* be substantially uniform throughout the entire width of the filter means. The achievement of such substantially uniformity is effected, without clogging up of screens, etc., by grease particles, as described in detail in my copending application Ser. No. 509,555, filed Sept. 26, 1974, for Apparatus and Method for Extracting Grease and Smoke, and Method of Installing the Same, now U.S. Pat. No. 3,952,640. Said patent application is hereby incorporated by reference herein as though set forth in full. Such application describes an extended plenum 150 which communicates with the plenum chamber or exhaust chamber 27 on the downstream side of the filter means 3*a*. Referring to FIG. 2 of the present application, the extended plenum 150 communicates with an exhaust blower 44 which discharges filtered air and fumes to the ambient space outside of the room wherein the cooking appliance is disposed.

The above-mentioned generally horizontal throat portion 12 is defined on the lower side thereof by an upwardly inclined baffle plate 18 having a further upwardly inclined lip 19 at the rear edge thereof. For reasons of economy of production, and maintenance of the precise desired angles, the baffle plate 18 and its lip 19 are preferably fixed in position, for example, by angle bars (not shown in the present drawing) which are suitably secured to the side walls of the apparatus. To prevent sagging of the central region of the baffle plate 18, a connector element 22 (incorporating a turnbuckle) is connected between the central region of the baffle plate and the central region of the substantially continuously curved member (described below) thereabove.

As described in said U.S. Pat. No. 3,664,255, not all of the inlet air from the duct means 10 passes through the throat 12, since some passes downwardly through a gap 23 (FIG. 1) and then strikes a ledge means 24 disposed at the front portion of the apparatus. The ledge means 24 redirects the air rearwardly toward the capture and entrainment chamber "C".

There is shown in FIG. 1 a substantially continuously curved vortex liner which is numbered 31 and curves upwardly from the filter 3*a*, thence forwardly, downwardly and rearwardly for termination at a section 51 and a lip 52 disposed above lip 19. Such vortex liner is described in detail in the U.S. Patent No. 3,943,836. With the described forced-flow apparatus, by far the greatest part of the air which passes out through the filters 3*a* is not supplied from the room (kitchen) but instead comes directly from the outside of the room. For example, in a typical installation only about ten percent of the air comes from the room whereas ninety percent of the air comes from the outside. This room air (typically about ten percent) is that which flows upwardly convectively from the cooking appliance as described below.

DESCRIPTION OF THE CONVECTIVE-FLOW PORTIONS, EMBODIMENT OF FIGS. 1-3, AND OF THE COOKING APPLIANCE

The above-described grease hood is shown as being mounted adjacent a vertical wall 61 which separates the kitchen 62 from, for example, the dining room 63 of a restaurant. In the illustrated embodiment, there is a pass-through opening 64 in such vertical wall 61, through which cooked food is passed by the chefs to waitresses in the dining room 63. The pass-through opening 64 is disposed a substantial distance above the upper surface 66 of a stove or other cooking appliance 67.

It is pointed out that the cooking appliance 67 may not only be a conventional stove but may be a charbroiler, french fryer, etc. regardness of the type of cooking appliance which is employed, reference may sometimes be made to the expression "cooking surface" as denoting in the upper region of the appliance, that closest to the grease-hood system.

In the specific showings of a patent application filed by the present inventor on even date herewith for a Grease-Hood Apparatus, the forced-flow portion of the grease hood is disposed sufficiently low that the open bottom thereof is substantially below the elevation of the head of the cook (the cook being of conventional or average stature for an adult male human). Thus, in such a system, the entry portion of the grease-hood system is the bottom of the hood (there being no intervening chimney, etc.). In the apparatus illustrated in the present FIG. 1, however, as well as in the specific embodiments described subsequently in the present application, the forced-flow portion of the hood is disposed at a relatively high elevation and there extends downwardly therefrom a chimney means which may or may not incorporate a shelf, pass-through, etc. Thus, in the embodiments specifically described in the present application, the entry or intake portion of the grease-hood system (into which air and fumes convect as described below) is disposed in spaced relationship above the cooking appliance 67 but is disposed substantially below the forced-flow portion of the system.

Referring again specifically to FIG. 1, wall and/or shelf means are interposed between the forward region 68 of the upper surface 66 and the forward 69 of the grease hood thereabove. In the illustrated embodiment there are three such wall means, one being a shelf 72 which is suitably mounted in horizontal relationship and generally level with the lower region of pass-through opening 64, the second being a horizontal plate shelf 73 which is also suitably mounted in horizontal position but level with the upper region of pass-through 64, and the third being a wall 74 which is mounted below the forward portion of the capture and entrainment chamber "C".

The shelf 72 extends entirely through the pass-through opening 64, but an intermediate portion 75 of shelf 72 is open and is provided with a perforated element or grill 76 through which fumes may pass upwardly from the stove 67 to the grease hood. Thus, the chef may store food, etc., on the front (right in FIG. 1) portion of the shelf 72, and then, when desired, slide the food over the grill 76 and through the pass-through opening 64 to the rear region of shelf 72, where it is easily and conveniently picked up by the waitresses.

The plate shelf 73 is a storage area for clean plates (and food which it is desired to maintain warm) which are maintained relatively warm due to the proximity of a chimney 79. Such chimney is defined above the grill 76 of the shelf 72 and to the rear of the plate shelf 73. Stated more specifically, the upper region of the chimmney 79 is defined between the wall 61 of the room and a vertical wall 80 which extends upwardly from the rear edge of plate shelf 73 to the rear edge of wall 74.

It is emphasized that the forward region 68 of the cooking surface of appliance 67 protrudes or extends forwardly a substantial distance from beneath the forward edge 72*a* of shelf 72. The amount of this protrusion may be substantial, for example about one foot or more, and is important in order to maximize the utilizable cooking surface while still permitting the cook to see the food and also manipulate the food as indicated subsequently relative to FIG. 4 of the present application.

In the operation of the embodiment of FIG. 1, the front (right in FIG. 1) region of shelf 72 acts somewhat in the nature of the upper portion of a fireplace in a household living room. Thus, air from the kitchen 62 tends to be drawn inwardly from the kitchen (away from the cook) into the space between stove (cooking appliance) surface 66 and the front region of the shelf 72, due to the heat generated by the stove (cooking appliance) 67 (which acts somewhat in the nature of a household fireplace). The convective air flow curves upwardly relatively adjacent vertical wall 61 and passes through the grill 76 to the chimney 79 and thence into the open-bottomed capture and entrainment chamber "C". In passing over the upper surface 66 of the cooking appliance 67, the convectively flowing air picks up the grease-laden cooking fumes and carries them upwardly therewith into such chamber "C", so that the fumes are separated and filtered and exhausted as described in detail previously in this specification.

The convectively flowing air which passes over surface 66 of the cooking appliance 67 tends to crowd adjacent such surface 66, as distinguished from being disposed at a higher elevation. The hotter the cooking appliance, the greater the amount of the described convective flow.

Although the embodiment illustrated in FIG. 1 incorporates the pass-through opening 64 and the associated shelf 72 and grilled opening 75, these may be omitted in some restaurants. The vertical wall 61 would then be continuous and devoid of an opening, and the shelf 72 and the grill 76 would then be omitted. Air would then convert upwardly from the stove (cooking appliance) 67 and would tend to be relatively adjacent the vertical wall 61. It would pass upwardly through the chimney 79 to the chamber "C". Such a relationship is described subsequently relative to FIG. 4 of the present application.

EMBODIMENT OF FIGS. 4–5

Figure 4:
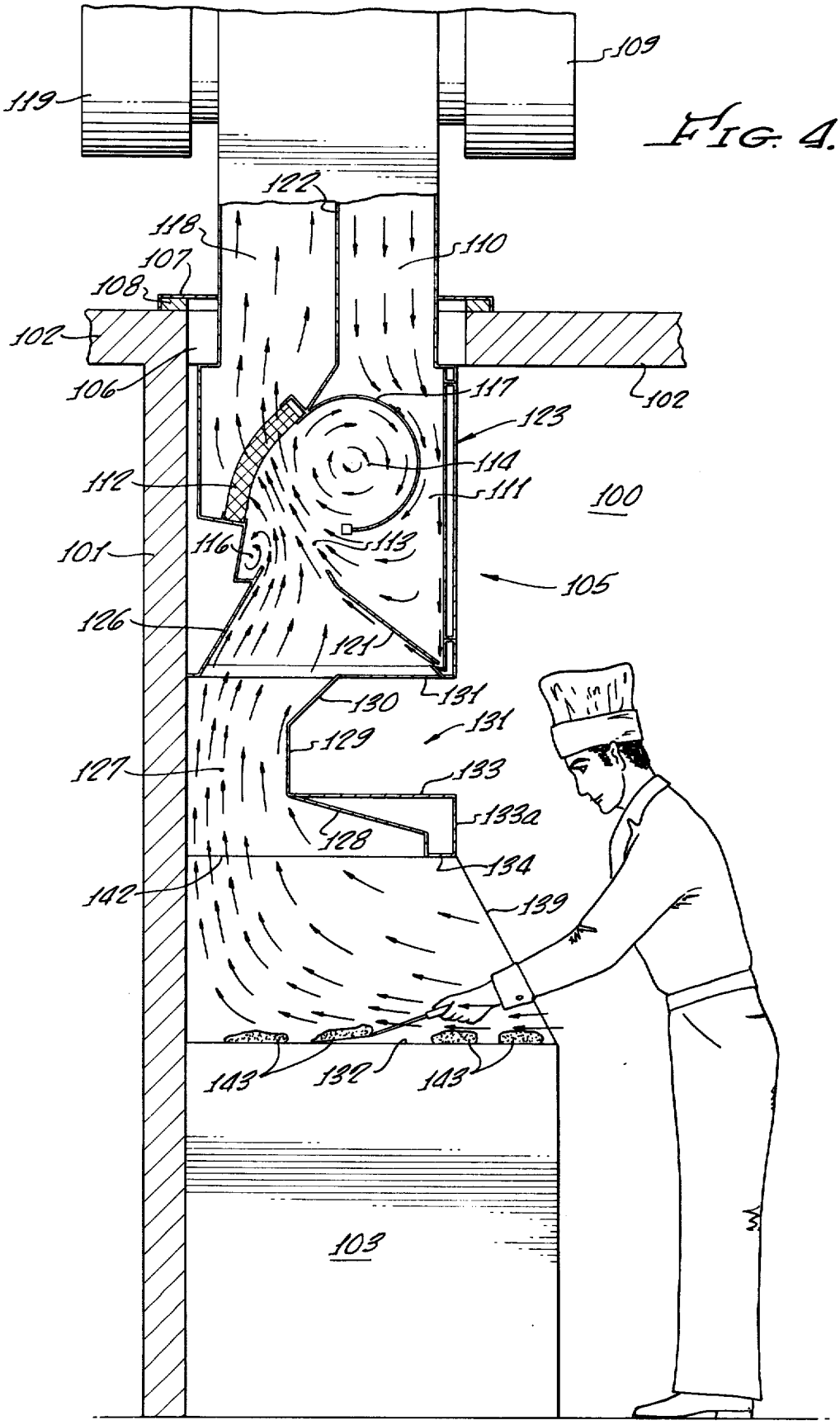
Figure 5:
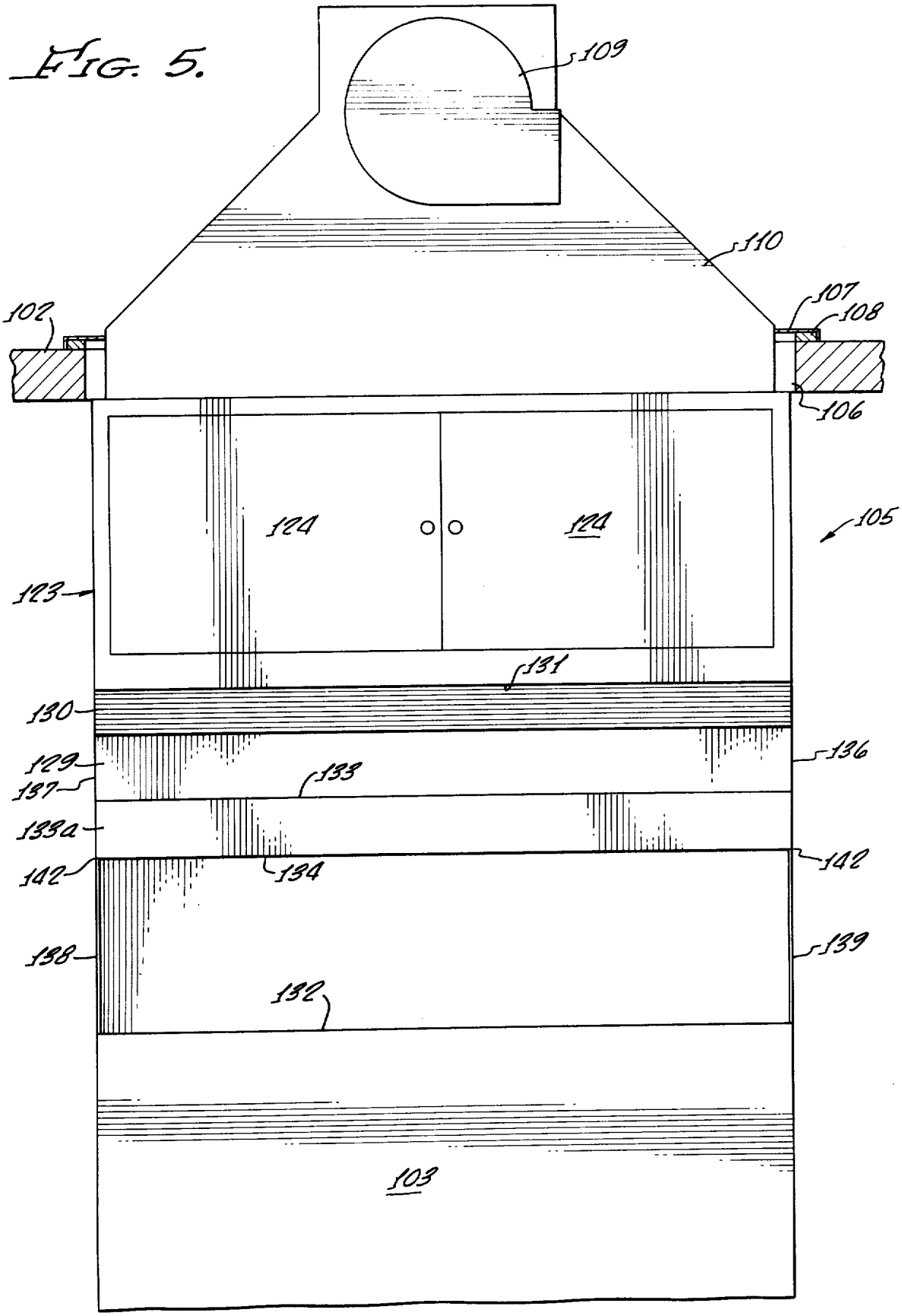
FIG. 5 is a front elevational view of the embodiment of FIG. 4, as viewed from the right in FIG. 4.

Referring next to FIGS. 4 and 5, these show a preferred embodiment of the plate-shelf form of the apparatus. The apparatus is shown as mounted in a room 100 (for example, the kitchen) having a vertical wall 101 and a ceiling or roof 102. The room 100 contains a cooking appliance 103 as indicated above relative to appliance 67 (FIG. 1).

The forced-flow portion of the grease-hood system is indicated at 105 and is the shallow-type described in detail on the above-cited patent application filed on even date herewith. Such forced-flow portion has a very small front-to-rear dimension, that is to say, a small dimension in a direction perpendicular to the vertical wall 101, thus achieving major benefits as described in said application filed on even date herewith. One of such benefits is that the apparatus may be introduced downwardly (vertically translated) through a preformed rectangular opening 106 in the ceiling 102, which opening is relatively small due to the small front-to-rear dimension of the apparatus.

The apparatus is constructed and introduced into the kitchen in accordance with the method described in the copending application Ser. No. 607,283, filed Aug. 25, 1975, for Apparatus for Extracting Grease and Smoke, and Method and Apparatus for Installing the Same, there being a weather-sealing horizontal element 107 secured to the ductwork and which extends over a rail 108 (rectangular) mounted on the upper surface of roof or ceiling 102. The seal means 107 and rail 108 cooperate to prevent ingress of water, etc., into the kitchen 100. Furthermore, they provide a support for the grease-hood system. Briefly summarized, the forced-flow portion 105 (which is described in detail in the copending application filed on even date) comprises an inlet blower 109 which takes air from the exterior of room 100 and passes its downwardly through an inlet plenum 110 to a vertical throat portion 111. From throat portion 111, the inlet air curves upwardly toward a grease filter 112, passing toward such grease filter means in the form of an air curtain or stream 113. Such curtain has entrained therein fumes from food on the appliance 103. Some portions of the mixture of fumes and air pass directly through the filter means 112, whereas others vortex upwardly to form a large upper vortex 114 and others vortex downwardly to form a small lower vortex 116.

The vortex liner is represented at 117, being curved and constructed as described in detail in the copending application. The filter means 112 are illustrated as being curved, again as described in the copending application.

The fumes and air which pass through the filter means flow upwardly through an outlet plenum 118 to an exhaust blower 119 and thence to the atmosphere.

Accordingly, in the forced-flow portion 105 of the apparatus there is forced flow of air and fumes and there is a filtering action as well as a vortex action.

A baffle plate 121 is disposed beneath the lower region of vortex liner 117 and cooperates therewith in forming an air-director or horizonal throat means through which the inlet air passes from vertical throat 111. Furthermore, as described in cited patent applications and patent, some of the inlet air passes downwardly below the lower (forward) edge of the baffle plate 121 and then is deflected upwardly to the curtain 113. Also as described in the copending patent application filed on even date herewith, the inlet and outlet plenums are separated by a divider wall 122, and the entire forced-flow portion of the grease-hood apparatus is enclosed in a generally rectangular housing 123. The housing 123 has doors 124 (FIG. 5) which are employed for achieving access to the filter means 112 as described in detail in the cited application.

The disclosure of the copending application, filed on even date herewith, is hereby incorporated by reference herein, as though set forth in full.

Proceeding next to a description of the convective-flow portions of the present grease-hood system, the open bottom of the chamber containing the air curtain 113 connects (at the gap between baffle 121 and an inclined deflector plate 126) with a chimney 127 located adjacent the vertical wall 101. In the illustrated form, the rear wall of the chimney is formed by the wall 101, whereas the formed wall of the chimney is formed by wall portions 128, 129 and 130 of a plate-shelf or food warming-shelf means 131 which is connected to the lower portion of the housing 123.

Stated more specifically, wall portion 130 inclines upwardly and away from wall 101, connecting at its upper edge to a horizontal wall 131 which is sealingly secured to the lower side of housing 123 at the forward region thereof. Wall portion 129 is shown as being vertical, and connects as its upper-edge to portion 130 and at its lower edge to the wall portion 128. Such portion 128 inclines downwardly and away from wall 101 to a region spaced a substantial distance above the cooking surface 132 of appliance 103, namely above the foward region of such cooking surface.

A horizontal plate-shelf or warming-shelf 133 connects at one edge of the junction between wall portions 128 – 129, and bends downwardly (at a vertical portion 133*a*) at right angles for connection to an angle region 134 which is secured to (or integral with) the lower edge of wall portion 128. The chimney means 127 also has vertical side walls, located at regions 136 and 137 (FIG. 5), such sidewalls extending downwardly generally to the elevation of the angle region 134.

All of the described elements are fully assembled at the factory, then vertically translated downwardly through the opening 106 in ceiling 102 to the indicated elevation or other desired elevation. The rear portion of the apparatus is illustrated as disposed adjacent the wall 101, but is to be understood that spacer members and/or vertical metallic members may be provided in this region if desired.

After the described installation of the forced-flow, chimney and plate-shelf elements, side plates 138 and 139 (FIG. 5) are suitably secured from the lower end of the plate-shelf and chimney means to the upper edges of the cooking appliance 103. Such side plates are illustrated (FIG. 4) as having inclined forward edges. It is to be understood that if the apparatus is disposed in a niche or alcove in a room, so that it is surrounded by walls of the room itself, these side plates 138–139 may be omitted. They may, furthermore, be omitted in some instances where side drafts are not a problem in the particular restaurant wherein the equipment is employed. The junctions between the side plates 138–139 and the chimney means are shown at 142.

METHOD, PARTICULARLY WITH RELATION TO THE EMBODIMENT OF FIGS. 4–5

As illustrated in FIG. 4, substantially the entire upper surface of cooking appliance 103 (which may be a stove, charbroiler, french fryer, etc., as previously stated) may be employed for cooking food. For purposes of illustration, there are shown various hamburgers 143 on a cooking surface 132. At least the front row of such hamburgers 143 is shown as being on the protruding portion of the stove or other cooking appliance 103, which portion is not overhung by the lower portion (or, in FIGS. 4–5, by any portion) of the grease-hood system.

The inlet and exhaust blowers 109 and 119 are caused to operate at such rates that, for the temperature normally employed relative to the particular cooking appliance 103, the flow of air across the cooking surface 132 will be substantially entirely the result of convection. As previously illustrated, the relationship is typically such that the inlet blower 109 supplies about ninety percent of the air which passes through the exhaust blower 119, the remaining ten percent (typically) being made up by convection of air and fumes across the cooking surface 132 and up the chimney means 127 to the open-bottomed capture and entrainment chamber of the forced-flow portion 105. In some cases, where it is desired to draw excess air from the room, the amount of flow delivered by the supply blower may be decreased somewhat, or that withdrawn by the exhaust blower increased, thus venting a small amount of excess room air as may be desired in the particular application.

As stated relative to the previous embodiment, the heat of the cooking surface 132 creates a convective action which causes air to flow rearwardly thereacross, as indicated by the relatively concentrated arrows, FIG. 4. Such air passes over the food 143 and then (together with the fumes) curves upwardly adjacent wall 101 and up through the chimney 127 to the forced-flow portion 105. The hotter the cooking surface, the greater this convective action is. There is no need to pass inlet air downwardly through ducts to the vicinity of the cooking appliance 103, no need for any venturi effects, and no need for any exhausting of major amounts of air from the room 100.

Because of the stated (and other) factors, the present system is extremely economical to operate as well as easy to install. There are no major or uncomfortable drafts in the room 100, not even adjacent the cook, this being contrasted with systems when there is high-velocity forced-flow of air across the cook station.

As illustrated in FIG. 4, the cook has a clear line of sight to all portions of the cooking surface 132, and can readily reach any portion thereof. Furthermore, when the cook bends forwardly he does not bump his head due to the fact that the cooking surface protrudes outwardly from beneath the entire lower portion to the grease-hood system.

In the cited copending patent application, filed on even date herewith, the entry portion of the grease-hood system is at the bottom of the forced-flow means since such means is at a much lower elevation in such application (wherein no plate-shelf is specifically illustrated). Regardless of what type of system is employed, the "lower portion" thereof is that beneath the elevation of the head of an adult male cook of normal height, when such cook is standing adjacent the apparatus. The "lower-end" of the "lower-portion" is where the convecting air and fumes enter the system. In the embodiment of FIG. 4, such "lower end" is at junctions 142. In the embodiments specifically shown in the application filed on even date, such "lower-end" is the bottom of the forced-flow means.

In order to maximize the "sweeping" action by which cooking fumes from at least the front (protruding) portion of the cooking surface are moved convectively back beneath the entry or intake regions of the grease-hood system, instead of going upwardly into the room, it is preferred that the only air passage for the room air is the illustrated one in the forward-rearward direction. This result is achieved not only by the side walls 138–139, as described, but also by preventing air flow beneath the cooking appliance. For example, relative to some types of cooking appliances which have short legs, it is desirable to provides skirts or other air-blocking means to prevent air flow between such legs and instead to cause all convective flow to be above the cooking appliance.

The foregoing detailed description is to be clearly understood as given by way of illustration and example only, the spirit and scope of this invention being limited solely by the appended claims.

I claim:

1. A method of filtering and removing cooking fumes from the space above a cooking appliance which is located in a room in a restaurant, which method comprises:

a. providing a grease-hood system at least the lower portion of which has a front-to-rear dimension which is substantially less than the front-to-rear dimension of the cooking surface of the cooking appliance with which said grease-hood system is to be associated, b. mounting said grease-hood system in such manner that said lower portion is disposed over the rear portion of said cooking surface, whereby a front portion of said cooking surface protrudes forwardly a substantial distance from beneath said lower portion, said mounting also being such that said lower portion is disposed at an elevation below that of the head of a normal-stature adult male cook who is standing on the floor at the front of said cooking appliance, with the lower end of said lower portion spaced substantially above said cooking surface and far below the head of said cook, c. cooking food on said cooking surface, including on said front portion thereof which protrudes from beneath said lower portion of said grease-hood system, said cooking resulting in convective flow of air from said room in a rearward direction over said food and thence in an upward direction to said lower end of said lower portion, d. passing said convectively-flowing air and the cooking fumes extrained therein upwardly into said lower end of said lower portion, said rearward flow of air and fumes over said food, and said passing of air and cooking fumes into said lower end of said lower portion, being effected substantially entirely by said convective flow of room air, in the absence of any substantial venturi, blowing or sucking action, e. effecting direct forced flow of air into said grease-hood system from a region exterior to said room, said forced-flow air entering said system at a region above said lower end of said lower portion, and entraining therein the air and fumes which pass upwardly as recited in step (d), f. passing through grease-filter means the forced-flow air and the convected air and fumes, and g. exhausting to the exterior of said room the air and fumes thus filtered by said grease filter means.

2. The invention as claimed in claim 1, in which said method further includes the step of effecting large-diameter vortical flow of a large proportion of air and fumes immediately prior to performance of said step (f).

3. The invention as claimed in claim 1, in which said steps (e) and (g) are performed by blower means, and in which the amount of forced-flow air supplied by said step (e) is on the order of about 10 percent less than the amount of air and fumes exhausted by said step (g).

4. The invention as claimed in claim 1, in which said method further includes the step of providing a wall at the rear of said cooking surface and extending up to said lower end of said lower portion.

5. The invention as claimed in claim 4, in which said method further includes the step of providing walls at the sides of said cooking surface and extending up to said lower end of said lower portion.

6. The invention as claimed in claim 1, in which said method further includes the step of blocking flow of convecting air beneath said cooking appliance.

7. A combination grease-hood and cooking appliance apparatus, which comprises:

a. a cooking appliance having at the upper portion thereof a cooking surface the front-to-rear dimension of which is relatively large, b. a grease-hood apparatus at least the lower portion of which has a front-to-rear dimension which is relatively small in comparison to said front-to-rear dimension of said cooking appliance, said grease-hood apparatus being mounted above said cooking appliance, at such location that (1) the front region of said cooking surface protrudes forwardly a substantial distance from at least said lower portion of said grease-hood apparatus, and (2) the lower end of said lower portion is spaced above said cooking surface and is disposed at an elevation far lower than that of the head of a normal-stature adult male cook standing on the floor at the front of said cooking appliance, said grease-hood apparatus, said cooking appliance and regions adjacent thereto being devoid of means to blow or suck substantial amounts of air either rearwardly across food cooking on said cooking surface, including said front region of said cooking surface, or upwardly into said lower end of said lower portion, whereby rearward flow of air and fumes across said food, and upward flow of air and fumes into said lower end of said lower portion, are substantially entirely the result of convection caused by the heat generated by said cooking appliance, c. forced-flow means to deliver directly to the interior of said grease-hood apparatus, from the region exterior to the room wherein said cooking appliance is disposed, a stream of air which entrains therein the air and fumes convected from said cooking appliance into said lower end, d. grease-filter means provided in said grease-hood apparatus to filter grease from the air and fumes thus present in said grease-hood apparatus, and e. means to exhaust from said grease-hood apparatus, to a region exterior to said room, air and fumes which are filtered by said filter means of clause (d).

8. The invention as claimed in claim 7, in which said apparatus further includes means to create a large-diameter vortex of said forced-flow air and said convected air and fumes at a region in said grease-hood apparatus adjacent and on the upstream side of said grease-filter means.

9. The invention as claimed in claim 7, in which first and second blower means are incorporated respectively in said forced-flow means of clause (c) and said exhaust means of clause (e).

10. The invention as claimed in claim 7, in which a wall extends upwardly from the rear of said cooking surface to said lower end of said lower portion.

11. The invention as claimed in claim 7, in which walls are provided at the sides of said cooking surface and extend upwardly to said lower end of said lower portion.

12. The invention as claimed in claim 7, in which said lower portion comprises a chimney means, and incorporates a shelf for the support and warming of plates and food.

* * * * *